United States Patent [19]

Fukumoto

[11] Patent Number: 4,955,830

[45] Date of Patent: Sep. 11, 1990

[54] CONNECTORS

[76] Inventor: Noriyoshi Fukumoto, 21-6, Sakuragaoka 2-Chome, Setagaya-ku, Tokyo, Japan

[21] Appl. No.: 414,522

[22] Filed: Sep. 29, 1989

Related U.S. Application Data

[63] Continuation of Ser. No. 289,801, Dec. 27, 1988, abandoned.

[30] Foreign Application Priority Data

Dec. 27, 1987 [JP] Japan ..... 62-198469
Feb. 10, 1988 [JP] Japan ..... 63-16667

[51] Int. Cl.[5] ..... H01R 4/48
[52] U.S. Cl. ..... 439/821; 439/819
[58] Field of Search ..... 439/787, 788, 799, 819, 439/820, 821, 816, 827

[56] References Cited

U.S. PATENT DOCUMENTS 2,872,659 2/1959 Wills ..... 439/819
3,982,806 9/1976 Wilson et al. ..... 439/820
4,230,388 10/1980 Thierry et al. ..... 439/819
4,775,335 10/1988 Havel ..... 439/820

FOREIGN PATENT DOCUMENTS 0236594 2/1969 U.S.S.R. ..... 439/821
0898543 1/1982 U.S.S.R. ..... 439/821

*Primary Examiner*—David L. Pirlot
*Attorney, Agent, or Firm*—Fred Philpitt

[57] ABSTRACT

A socket is constructed in such a way that six pieces of segments which are made of electric conductive bar and having a regular hexagonal cross section are assembled by a centripetal force of a spring band to provide a regular hexagonal plug inserting hole in its center, and the six pieces of the segments make an independent operation without restricting other segments mutually and having the contact pressure and make a positive corresponding operation against the center offset and the error of the inserting angle of the plug when the plug is inserted and each segment applies the contact pressure simultaneously against the plug to maintain the complete contact with the plug.

6 Claims, 9 Drawing Sheets

101
106
106
106
110
110
119
123
124
B'

CONNECTORS

This is a continuation of Ser. No. 289,801, filed Dec. 27, 1988, now abandoned.

BACKGROUND OF THE INVENTION

This invention relates to connectors for use in hanging bell type ambient electric furnaces, for mobile power source vehicle tap changing and the like, and particular relates to connectors in which 6 pieces or segments each of which is formed of regular hexagonal plug, with an inserting hole in its center and a spring band for clamping the 6 pieces of the assembled segments with its centripetal force are provided.

Heretofore, as connectors, for example, connecting devices for hanging bell type ambient electric furnaces, mobile power source vehicle tap changing and the like, plug type members have been provided, but in the conventional connecting devices of this kind, a socket that becomes the stationary side, if there is a center offset in the insertion of plug, cannot correspond to the center offset and also, if an inserting angle of the plug is not appropriate, a gap is produced on a contact surface formed between the plug and the socket thereby reducing a contact area, and causing a burnout trouble easily resulting from an inferior contact, and moreover, since the socket is formed of a closed structure, the elastic force of groove formed on the socket is lost by the burnout which results in more frequent inferior contacts, shortening the service life, and furthermore, in the large size plug type connecting devices of the conventional structure, the manufacture thereof is difficult which are used for connection of large electric current of 2000 to 3000 ampares, or super large capacity such as 36 KV to 168 KV which have been drawbacks.

SUMMARY OF THE INVENTION

An object of this invention is to provide a socket in which 6 pieces of electric conductive bars whose cross section is a regular hexagonal cross section are bundled to form a plug inserting hole of a regular hexagonal cross section in its center, and a spring band is provided to clamp the 6 pieces of the assembled segments with its centripetal force, and the 6 pieces of the segments forming the socket make an independent operation without restricting other segments mutually and having contact pressure, and make a corresponding operation positively against the center offset and an error of an inserting angle when the plug is inserted so that the contact pressure is applied by each segment simultaneously against the inserted plug and thus, the complete contact with the plug is maintained.

An object of this invention is to provide a socket capable of radiating heat through a gap formed between the 6 pieces of the segments, said gap being formed by inserting the plug into the socket consisting of the 6 pieces of the segments clamped with the spring band so that a rise of temperature is limited to a minimum, and is capable of making a self cleaning action of discharging foreign matters in the socket through the gap.

Another object of this invention is to provide a socket formed in such a way that its structure is formed by assembling the 6 pieces of the segments with a stationary band in the rear part of the segments, and the 6 pieces of the segments forming the socket which are clamped by the spring band to provide a regular hexagonal plug inserting hole in its center and to give a centripetal force operate independently and having an independent contact pressure so that the socket is capable of eliminating the apprehensions of causing the inferior contacts resulting from irregular bundling of each segment by the repulsive force of the magnetic power working at the instant of the entering of the plug, failing to make the simultaneous contact of the 6 pieces of the segments with the plug which produce the contact in disorder with an instant time lag or resulting from an out of balance of the whole 6 pieces of the segments due to the insertion of one piece of the segment or the specific segment only into the rear part by and advancement of the plug which causes the retreat of the segment. Furthermore, the foregoing socket is capable of eliminating the occurrence of the burnout trouble due to the inferior contact completely by causing the 6 pieces of the segments to contact the plug simultaneously and completely when the plug enters the socket.

A further object of this invention is to provide a socket by assembling the 6 pieces of the segments of electric conductive bars whose cross section is a regular hexagonal shape to form a plug inserting hole of a regular hexagonal shape in its center, and the socket proper employs a means of inserting a plug into the plug inserting hole from both ends of the socket proper to connect a primary side and a secondary side by means of the plug, and a pressure bonding terminal of cord is connected to a flat surface type terminal portion of each plug of the primary side and the secondary side by the face contact so that the connection with the face contact is made possible by enlarging the contact area of the terminal portion to a maximum, and a plurality of bolts and nuts are used to clamp the segments according to the rating whereby the energization is taken place at a high efficiency.

DETAILED DESCRIPTION OF THE INVENTION

Figure 1:
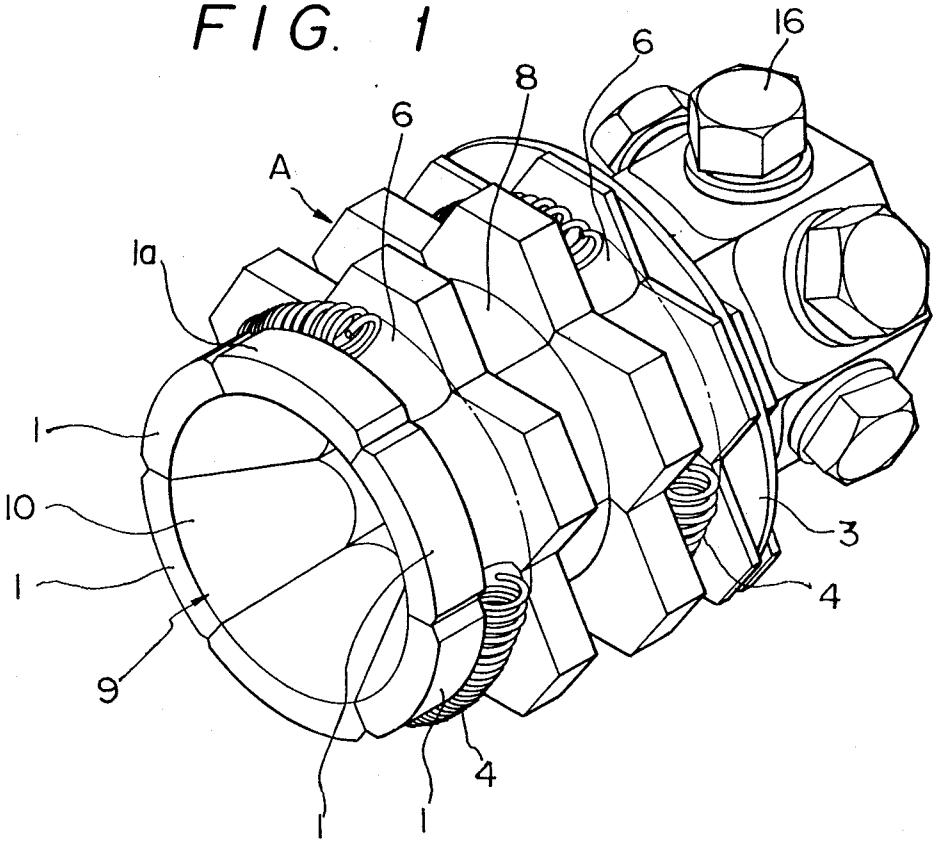
FIG. 1 is a perspective view of a socket consisting of the 6 pieces of assembled segments.
Figure 2:
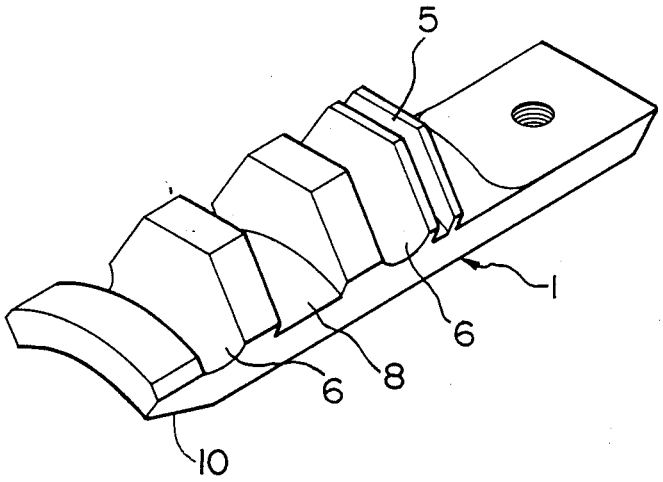
FIG. 2 is a perspective view of one segment.
Figure 3:
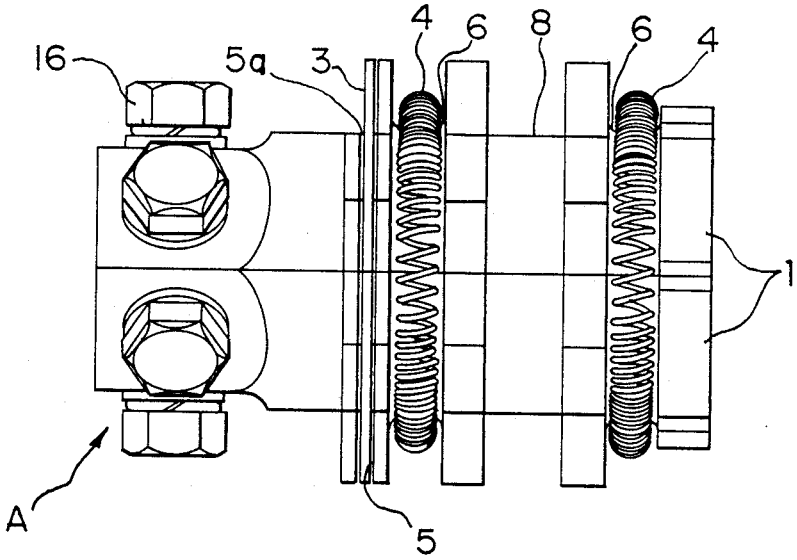
FIG. 3 is a side view of the socket.
Figure 4:
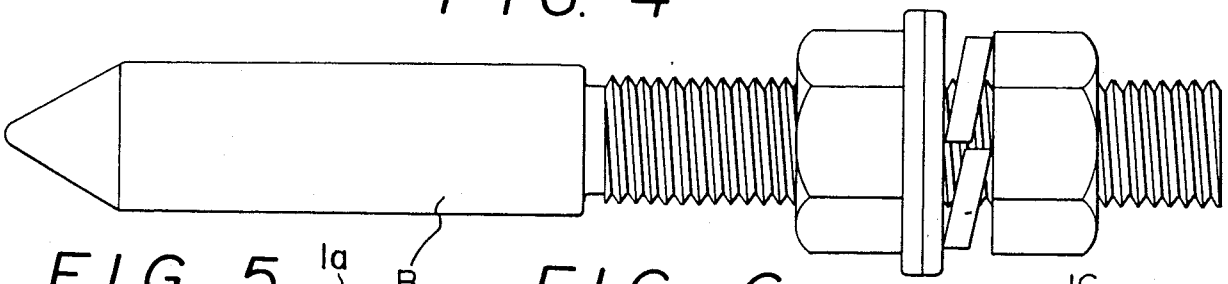
FIG. 4 is a side view of the plug.
Figure 6:
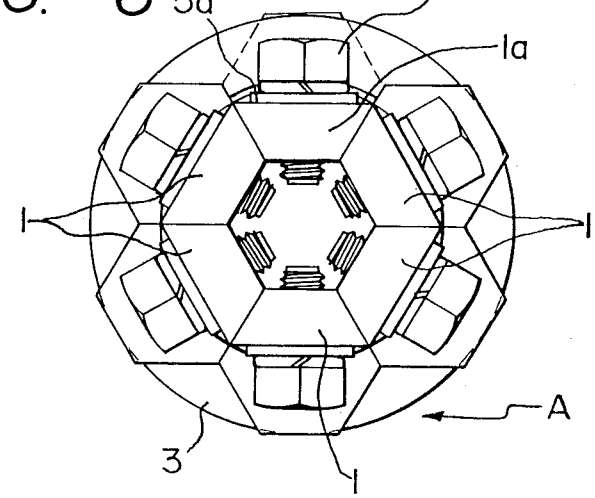
FIG. 6 is a rear view of the socket.
Figure 5:
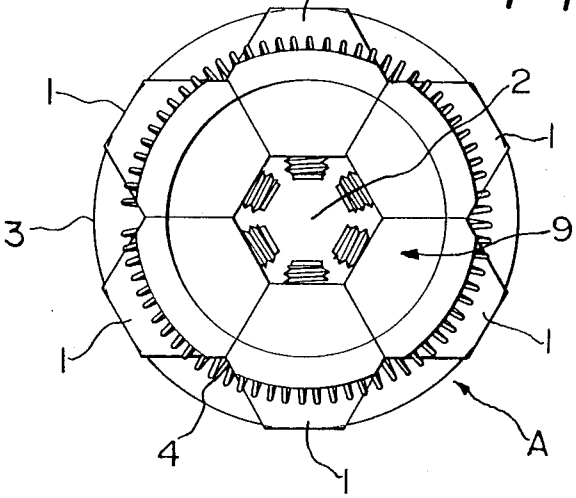
FIG. 5 is an elevation of the socket.
Figure 7:
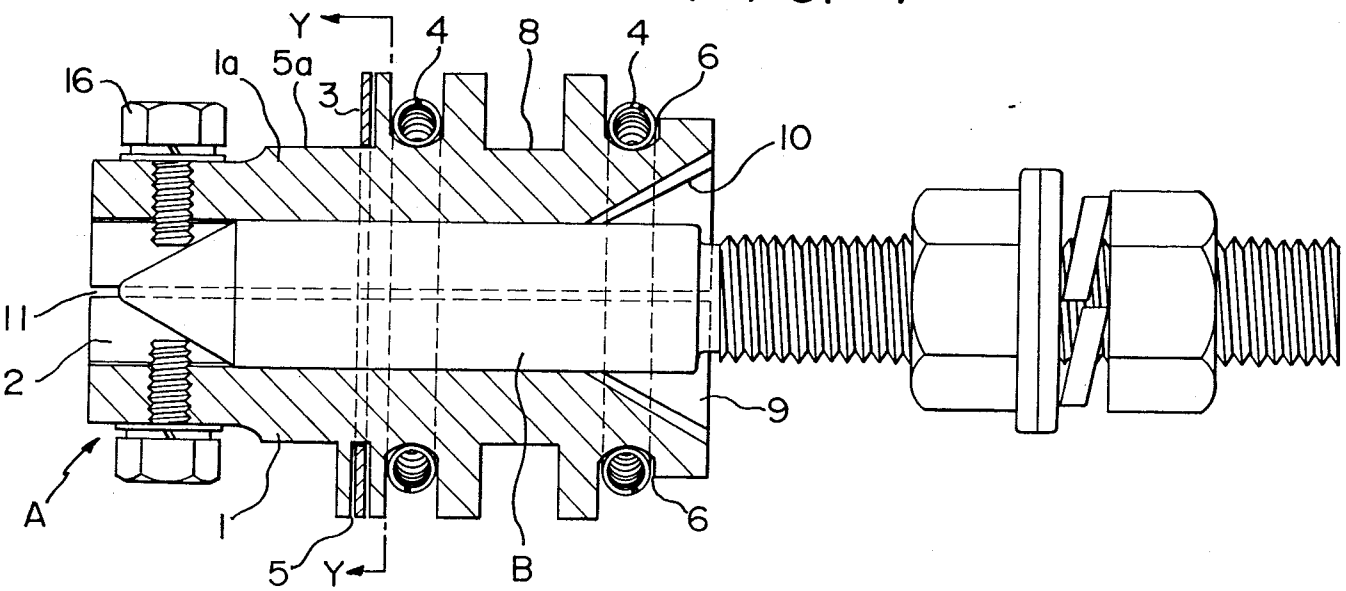
FIG. 7 is a cross section showing the plug inserted into the socket.
Figure 8:
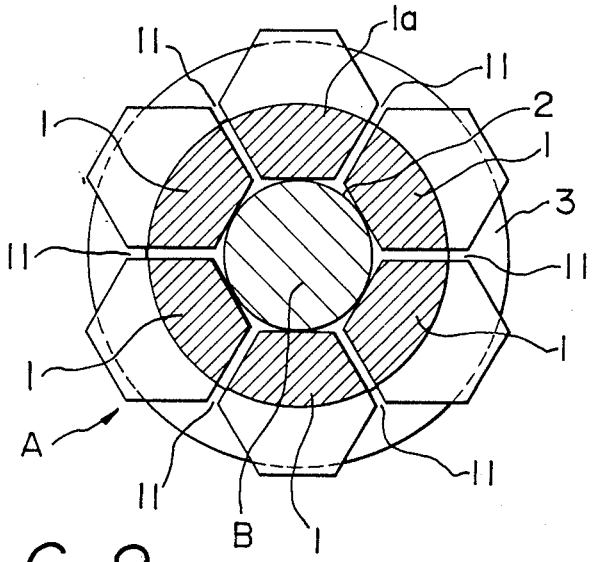
FIG. 8 is a cross section taken along a line Y—Y of FIG. 7.

FIG. 1 is a perspective view of a socket A according to a first embodiment of this invention, and the socket A is formed by assembling six of the segments shown in FIG. 2. The segment 1, as shown in FIGS. 5, 6 and 8, is formed in a regular hexagonal shape from an electric conductive bar, and said 6 segments 1 are bundled and assembled to form a plug inserting hole 2 of a regular hexagonal shape. The 6 pieces of the assembled segments 1 are clamped together by a spring band 4 which provides a centripetal force to the segments. The 6 segments 1 are assembled by a stationary ring 3 provided at its rear part. A plug B shown in FIG. 4 is inserted into the plug inserting hole 2 of the socket A as shown in FIG. 7 whereby the plug B and the socket A are connected.

In the 6 segments 1 forming the socket A, 5 of the segments 1 are formed with a strip groove 5 for the insertion of the stationary ring 3, and the remaining one segment 1*a* is formed in such a way that a rear part from the location corresponding to the strip groove 5 of the segment 1 is notched at 5*a* and is removed to form a low flat surface towards the rear end. In the assembly of the socket A, initially, the stationary ring 3 is fitted in each strip groove 5 upon assemblage to form the plug inserting hole 2 in its center by the 5 segments 1 . . . having the strip groove 5, and finally, the segment 1*a* having the notch 5*a* is incorporated into the 5 segments 1 . . . by abutting and positioning the notch 5*a* at the stationary ring 3 whereby the 5 segments 1 . . . and the remaining one segment 1*a* are assembled and retained.

Furthermore, the 6 segments 1 are formed with concave grooves 6, 6 for insertion of the spring band 4 at two locations which are adjacent to the front surface of the strip groove 5 of the front and rear part, and a concave groove 8 is formed to mount a mounting plate 7 to be described hereinafter between the two concave grooves 6, 6. The segments are clamped together by the centripetal force of the spring band 4, and the socket A is installed on the mounting plate 7 as shown in FIG. 9.

The mounting plate 7 is installed on support frames 13 erected on the right and left sides of a base 12, and the mounting plate 7 is retained and installed to be shiftable against the support surface, and the concave groove 8 of the socket A is fitted in a through hole 14 of the support plate 7 and thus, the center axis of the socket A is tiltable in an optional direction.

Figure 9:
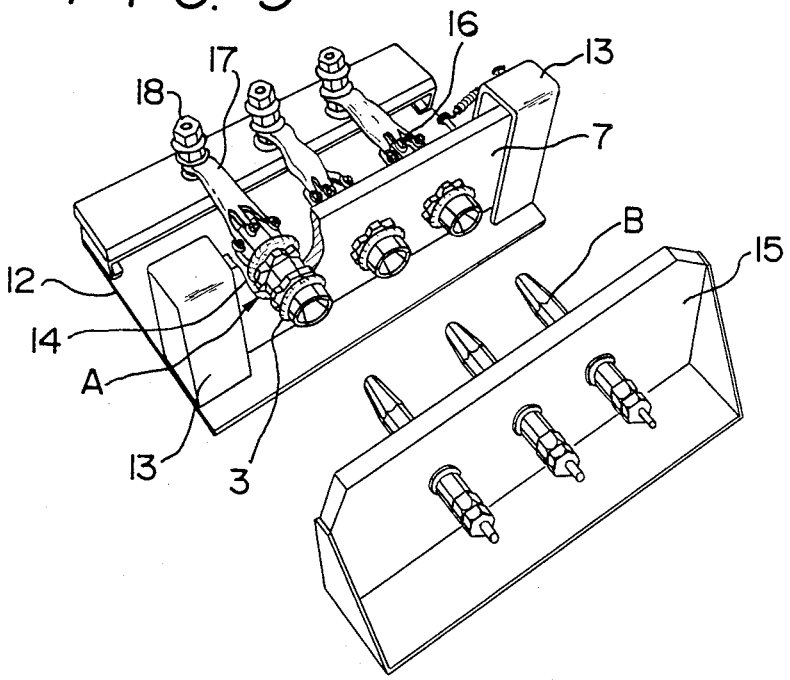
FIG. 9 is a perspective view showing how the socket and the plug are installed on a support base respectively.

By the way, in FIG. 9, the plug B is shown in the condition of being installed on the support base 15. A rear end of each segment 1 of the socket A is connected to one end of a flat cable 17 by means of a terminal bolt 16, and the other end is connected to a terminal end 18 of the base 12.

The socket A is formed in such a way that a tapered portion 10 is provided on the tip portion of the surface of each segment 1 and 1*a* to thereby form a tapered inserting opening 9 for the plug inserting hole 2.

The plug B is formed from a columnar shaft whose diameter is slightly larger than that of the plug inserting hole 2 of the socket A, shown in FIG. 5 and 6 so that when this plug B is fitted into the plug inserting hole 2 of the socket A, a gap 11 will be formed between spaces of the 6 segments 1 as shown is FIG. 8.

Accordingly, the 6 segments 1 forming a regular hexagonal cross section are bundled to provide a plug inserting hole 2 of a hexagonal cross section in its center and the 6 segments are assembled and retained by a stationary ring 3 at the rear part of the 6 segments, and the 6 assembled segments 1 are clamped by the spring band 4 to form the socket A by its centripetal force, and this socket A is constructed in such a way that the 6 segments 1 perform an independent operation without restricting the other segments mutually. The segments 1 perform the repulsive action individually upon the working of the repulsive force of the magnetic power at the instant of the entering of the plug B, but at this time, in order to prevent the repulsion of the 6 segments in disorder or to prevent the retreat of the specific one or more than one of the segments upon being inserted into the rear part, the 6 segments 1 are caused to be repulsive uniformly as a whole by the locking action of the stationary ring 3, and the 6 segments 1 can be contacted with the plug B simultaneously and completely. The 6 assembled segments which perform the independent operation without restricting other segments mutually and having the contact pressure perform the positive operation against the center offset of the plug or the error of the inserting angle and apply the contact pressure simultaneously against the plug by the segments whereby complete contact with the plug can be maintained. Furthermore, the 6 segments 1 clamped by the spring band 4 produce the gap 11 between the 6 segments 1 as a result of the enlargement of the socket A by resisting the spring band 4 when the plug B is inserted, A by resisting the spring band 4 when the plug B is inserted, and the heat radiation action is caused through the gap 11 to minimize the temperature rise and to effect the self cleaning action of discharging the foreign matters in the socket A through the gap 11.

The socket A is formed by the easy assemblage of the 5 segments 1 having the strip groove 5 for fitting the stationary ring 3 and one segment 1*a* having the notch 5*a* to provide the abutting surface which abuts the stationary ring 3.

The socket A installed on the mounting plate 7 is constructed in such a way that the center axis of the socket A is made to be eccentric according to the transfer of the mounting plate 7 and at the same time, the center axis of the socket A is made tiltable in an optional direction, and its posture is controlled automatically in correspondence to the center offset of the plug B or the error of the inserting angle thereof and moreover, after the insertion of the plug B, the 6 segments operating independently without restricting other segments 1 mutually and having the contact pressure automatically absorb and control the center offset or the error of the inserting angle of the plug B to ensure complete and positive contact between the plug B and the socket A.

FIG. 10 through FIG. 15 show a second embodiment according to this invention, and in this embodiment, the plug B′ is inserted into both ends of the socket A′ to connect a primary side and a secondary side by means of the plug, and thus, a connector to be used for electric connection of large electric current in the order of 36 KV to 168 KV is provided.

Figure 10:
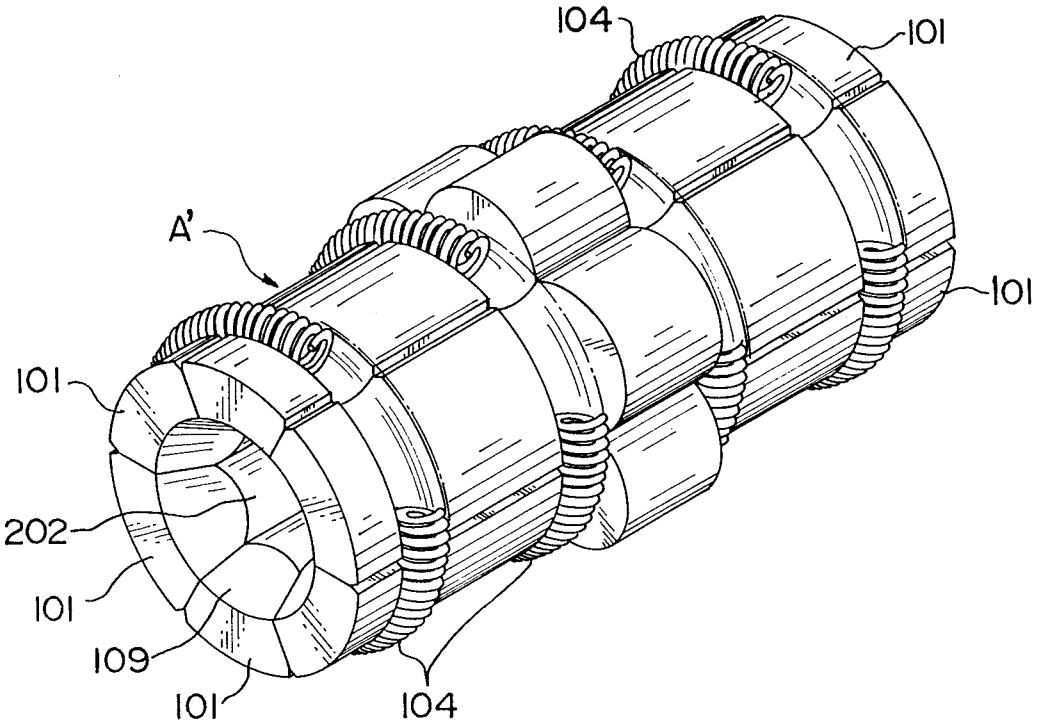
FIG. 10 is a perspective view of a socket according to a second embodiment of this invention.
Figures 11, 12:
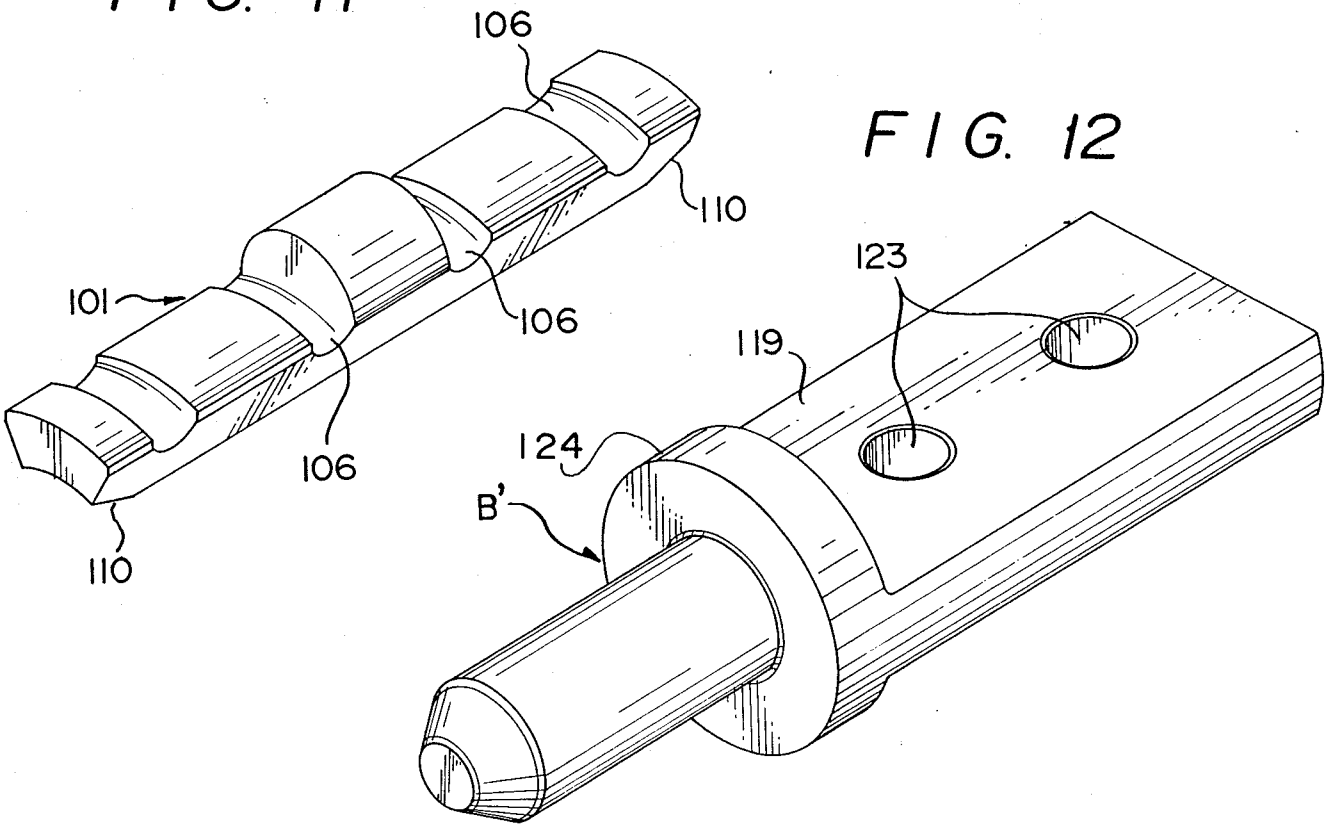
FIG. 11 is a perspective view of one segment or FIG. 10.
FIG. 12 is a perspective view of another plug.
Figure 13:
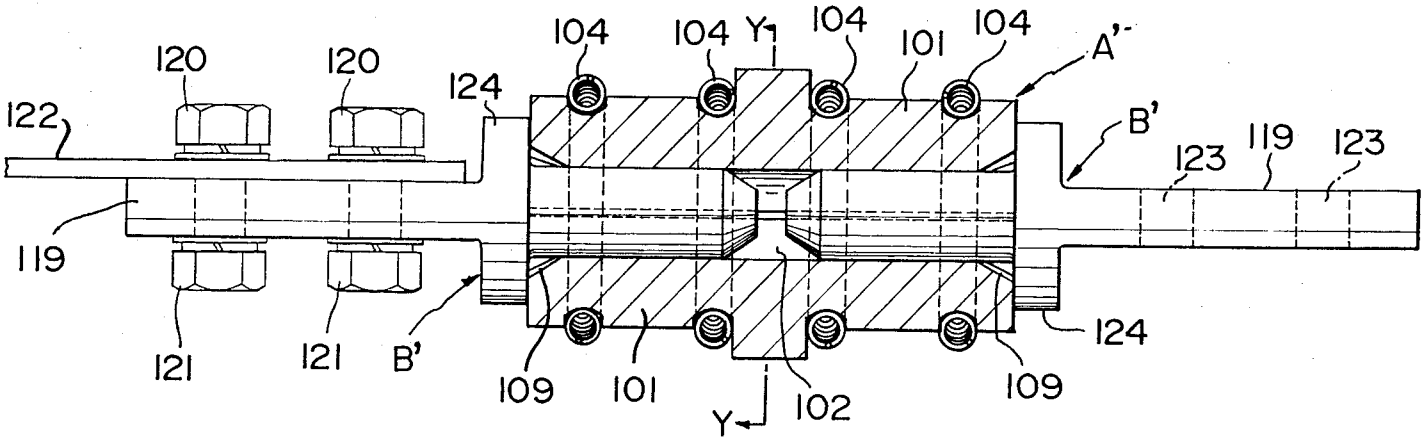
FIG. 13 is a cross section showing the plug inserted into the socket.
Figure 14:
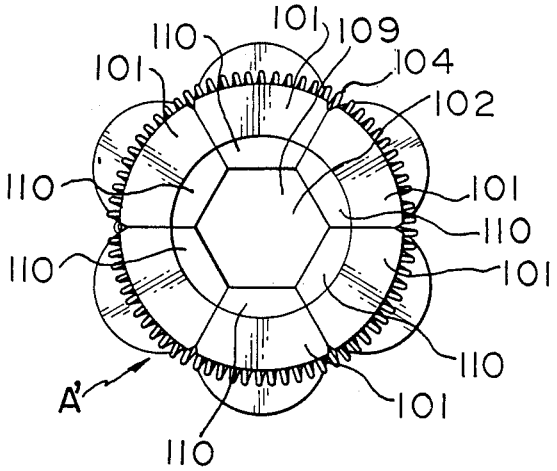
FIG. 14 is a side view of the socket.
Figure 15:
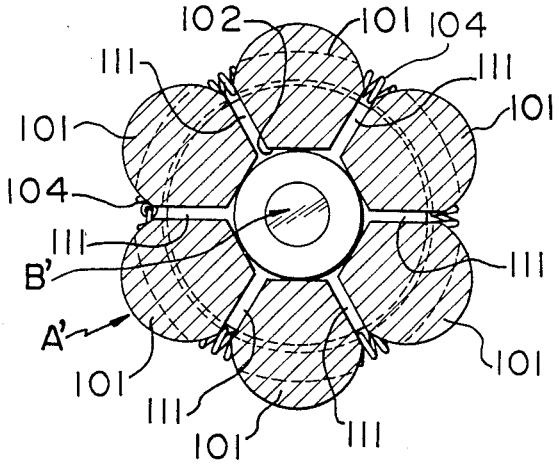
FIG. 15 is a cross section taken along a line Y—Y of FIG. 13.

The socket A′ shown in FIG. 10 in this embodiment is formed by assembling the 6 segments 101 shown in FIG. 11, and the segments 101 are formed in a regular hexagonal shape cross section from an electric conductive bar, and as shown in FIG. 10 through FIG. 13, the 6 segments 101 are bundled and assembled to form a regular hexagonal shaped plug inserting hole 102 in its center and the 6 assembled segments 101 are clamped by the centripetal force of the spring band 104, and the 6 segments 101 are formed with a plurality of concave grooves 106 for insertion of the spring band 104 at a fixed interval from the front part to the rear part. At both ends of the socket A′, in order to form the inserting openings 109, 109′ of the plug B′ in trumpet type, tapered portions 110, 110′ are formed on both end portions of the surface forming the inserting hole 102 of each segment 101, and the plug B′ shown in FIG. 12 is inserted into the plug inserting hole 102 through both ends of the socket A′ as shown in FIG. 13. Namely, in the second embodiment, wherein the plugs B′, B′ are inserted into the plug inserting hole 102 through the inserting openings 109, 109′ of both ends of the socket A′ whereby the primary side and the secondary side are connected by means of the plugs B′, B′, and the terminal portion 119 of the plugs B′ is formed in a flat surface on which a plurality of mounting holes 123 are formed for connection and fixing of pressure bonding terminal 122 by the bolt 120, nut 121 whereby the complete positive connection is provided by the surface contact because of the large area of the terminal portion 119 of the plug B′, and the efficient energization is carried out by clamping with the use of the bolt 120 and nut 121 through a plurality of mounting holes 123 according to the ratings, electric connection of the super large electric current, the desired large electric current, for example, in the order of 36 KV to 168 KV can be effected without apprehension and without limitation of the energy volume by the size of the pressure bonding terminal like the screw type for connection of the pressure bonding terminal in the socket A of the first embodiment with the bolt 16 or the size of the lead wire.

Also, in the second embodiment, the socket A′ prepared by assembling the 6 segments 101 with the centripetal force of the spring band 104 is constructed in such a way that each of the 6 segments 101 operates independently to provide the contact pressure. The plug B′ inserted to the secondary side of the socket A′ provides the locking operation with its flange portion 124 so that only one or more than two of the specific segments are inserted to be retreated by the contact of each segment 101 with the plug B′ by the repulsive force of the magnetic force working at an instant of the entering of the plug B from the primary side in disordered condition or the advancement of the plug B′, and the whole of the 6 segments 101 are uniformly caused to be repulsive and thus, the 6 segments 101 make simultaneous and complete contacting against the plug B′.

What is claimed is:

1. A connector comprising in combination:

(a) an assembly of six side-by-side segments
each segment being made of electrically conductive material,
each segment having a cross sectional portion comprising
(1) an inner half composed of three sides corresponding to one half of a hexagon, and
(2) an outer half,
said inner halves of said six segments forming with their innermost sides a hexagonal-shaped opening that is adapted to accommodate a plug, and (b) retaining means surrounding and pressing against the outer halves of said six segments, said retaining means including at least one resilient ring that exerts an inward force against said six segments and against any plug that is inserted into said hexagonal-shaped opening.

2. A connector according to claim 1 wherein said retaining means includes a stationary ring fitted around the outside of said assembled six segments, and the outer halves of five of said six segments being provided with an annular retaining groove to keep said stationary ring in place.

3. A connector according to claim 1 wherein said assembly of six side-by-side segments includes tapered inlet portions to facilitate the insertion of a plug into said hexagonal-shaped opening.

4. A connector according to claim 1, which includes a bolt extending through a portion of each segment, such bolts serving to limit the extent to which a plug can be inserted through said hexagonal-shaped opening.

5. A connector according to claim 1 wherein said outer half of each segment has three sides corresponding to one half of a hexagon.

6. A connector according to claim 5 wherein one of said six segments does not include an annular retaining groove to retain said stationary ring, so that the other five segments and said stationary ring can be initially positioned together so that they form an opening corresponding to five sides of a hexagon, and then the segment that does not include the retaining groove can be fitted into place in order to achieve the final assembly.

* * * * *